US006901622B2

(12) United States Patent
Thompson et al.

(10) Patent No.: US 6,901,622 B2
(45) Date of Patent: Jun. 7, 2005

(54) LINT-REMOVING BRUSH

(75) Inventors: Craig D. Thompson, Inver Grove Heights, MN (US); Jingxi Yiu, Plymouth, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 191 days.

(21) Appl. No.: 10/170,493

(22) Filed: Jun. 13, 2002

(65) Prior Publication Data

US 2003/0229958 A1 Dec. 18, 2003

(51) Int. Cl.[7] ..... A46B 15/00

(52) U.S. Cl. ..... 15/104.002; 15/1.52; 15/160; 15/210.1; D4/127

(58) Field of Search ..... 15/104.002, 1.52, 15/160, 210.1; D4/137

(56) References Cited

U.S. PATENT DOCUMENTS

| | | | | |
|---|---|---|---|---|
| D4,390 | S | | 10/1870 | Atwater |
| 2,708,761 | A | * | 5/1955 | Bergquist |
| 3,040,352 | A | | 6/1962 | Vian |
| RE25,435 | E | | 8/1963 | Norman |
| 3,105,256 | A | | 10/1963 | Giesler |
| RE25,675 | E | | 11/1964 | Du Bonnett |
| 3,330,077 | A | | 7/1967 | Kanbar et al. |
| 3,471,977 | A | | 10/1969 | Roth |
| 3,648,318 | A | | 3/1972 | Tsuruzawa |
| 3,765,046 | A | | 10/1973 | Tsuruzawa |
| 3,906,578 | A | | 9/1975 | Huber |
| 4,103,382 | A | | 8/1978 | Gitt |
| 4,422,201 | A | | 12/1983 | McKay |
| 4,627,126 | A | | 12/1986 | Nichols |
| 4,639,953 | A | | 2/1987 | McElmurry et al. |
| 4,639,965 | A | | 2/1987 | Suzuki |
| 4,642,835 | A | | 2/1987 | Schmitz |
| 4,905,337 | A | | 3/1990 | McKay |
| D309,376 | S | | 7/1990 | Kiesz |
| 5,027,465 | A | | 7/1991 | McKay |
| 5,148,571 | A | | 9/1992 | Brazis et al. |
| 5,388,300 | A | | 2/1995 | Hickey |
| 5,763,038 | A | | 6/1998 | Wood |
| 5,940,921 | A | | 8/1999 | Wood et al. |
| 6,055,695 | A | | 5/2000 | McKay, Jr. |
| 6,127,014 | A | | 10/2000 | McKay, Jr. |
| D483,952 | S | * | 12/2003 | Thompson et al. ..... D4/134 |

FOREIGN PATENT DOCUMENTS

| | | |
|---|---|---|
| DE | 94 15 428 | 11/1994 |

OTHER PUBLICATIONS

Six (6) photographs of a Helmac™ two–sided, rectangular–shaped head lint brush sold prior to Jun. 13, 2001 (including perspective, top, bottom, side, front, and back views).

Six (6) photographs of a Helmac™ single–sided, rectangular–shaped head lint brush sold prior to Jun. 13, 2001 (including perspective, top, bottom, front, and back views).

Six (6) photographs of a Helmac™ two–sided, oval–shaped head lint brush sold prior to Jun. 13, 2001. (including perspective, top, bottom, side, front, and back views).

Jos. A. Bank website advertisement of Three–In–One Brush, (1 page), 2002.

* cited by examiner

*Primary Examiner*—Deborah Jones
*Assistant Examiner*—Abraham Bahta
(74) *Attorney, Agent, or Firm*—David B. Patchett

(57) ABSTRACT

A lint-removing brush. The lint-removing brush having a handle portion, a lint-removing portion, and lint-removing material attached to the lint-removing portion, where the handle portion is connected to the lint-removing portion. In one preferred embodiment, the lint-removing portion includes a free end and a connecting end opposite the free end, a first side and a second side opposite the first side, where the distance between the first side and the second side near the free end is less than the distance between the first side and the second side near the connecting end.

17 Claims, 2 Drawing Sheets

LINT-REMOVING BRUSH

TECHNICAL FIELD

The present invention relates to a lint-removing brush. The present invention relates more particularly to a lint-removing brush having a handle portion, a lint-removing portion attached to the handle portion, and lint-removing material attached to the lint-removing portion.

BACKGROUND OF THE INVENTION

A variety of lint removal devices are known. Lint removal devices are designed to pick up particles or contaminants, such as lint, hair, threads, dirt, dust, or any other matter from a surface, such as floors, ceilings, furniture or other items, work surfaces, or clothing, to clean the surface. Examples of lint brushes are described in U.S. Pat. No. 3,648,318, U.S. Pat. No. 3,765,046, U.S. Pat. No. 4,639,953, U.S. Pat. No. 4,642,835, U.S. Pat. No. 5,148,571, and U.S. Des. 309,376.

Lint brushes are also sold under 3M brand name from 3M Company, based in St. Paul, Minn., under model number 836. Helmac Products Corporation, based in Flint, Mich., has also sold lint brushes in a variety of sizes under the brand name "Evercare."

Other lint removal devices are described in U.S. Pat. No. 6,055,695, U.S. Pat. No. 6,127,014, U.S. Pat. No. 5,940,921, U.S. Pat. No. 5,763,038 U.S. Pat. No. 5,388,300, U.S. Pat. No. 5,027,465, U.S. Pat. No. 4,905,337, U.S. Pat. No. 4,422,201, and U.S. Pat. No. 3,906,578, U.S. Pat. No. 3,471,977, U.S. Pat. Re. 25,675, and U.S. Pat. Re. 25,435

Other surface cleaning devices are described in U.S. Pat. No. 3,330,077, U.S. Pat. No. 4,103,382 and U.S. Pat. No. 3,105,256.

SUMMARY OF THE INVENTION

One aspect of the present invention provides a lint-removing brush. In one preferred embodiment of the lint-removing brush, the lint-removing brush comprises: a handle portion including a free end and a connecting end opposite the free end; and a lint-removing portion including a free end and a connecting end opposite the free end and including a a first side and a second side opposite the first side, where the distance between the first side and the second side near the free end is less than the distance between the first side and the second side near the connecting end, and where the connecting end of the handle portion is connected to the connecting end of the lint-removing portion.

In one aspect of the above embodiment, the lint-removing brush further comprises lint-removing material attached to the lint-removing portion. In another aspect of this embodiment, the lint-removing material extends from the first side to the second side around the free end of the lint-removing portion. In another aspect of the above embodiment, the lint-removing brush further comprises an indicator attached to the lint-removing portion, where a portion of the lint-removing material is orientated in a direction, and where the indicator points in the direction. In another aspect of the above embodiment, the lint-removing brush comprises a foam pad between the lint-removing portion and the lint-removing material. In another aspect of the above embodiment, the lint-removing brush further comprises a pad support between the lint-removing portion and the foam pad. In another aspect of the above embodiment, the pad support includes a first pad support portion, a second pad support portion, and a rounded surface connecting the first pad support portion and the second pad support portion, where the first and second pad support portion each includes an alignment rail and a locating slot. In another aspect of the above embodiment, the first side of the lint-removing portion includes a latch for engaging with the locating slot of the first pad support portion and includes a guide for engaging with the alignment rail of the first pad support portion and where the second side of the lint-removing portion includes a latch for engaging with the locating slot of the second pad support portion and includes a guide for engaging with the alignment rail of the second pad support portion.

The present invention also provides an alternative lint-removing brush. In one preferred embodiment of this lint-removing brush, the lint-removing brush comprises: a handle portion and a lint-removing portion connected to the handle portion, where the brush includes a brush axis; and lint-removing material attached to the lint-removing portion, where the lint-removing material intersects with the brush axis. In one aspect of the above embodiment, the lint-removing portion includes a free end and a connecting end opposite the free end, a first side and a second side opposite the first side, where the distance between the first side and the second side near the free end is less than the distance between the first side and the second side near the connecting end. In another aspect of the above embodiment, the lint-removing material extends from the first side to the second side around the free end of the lint-removing portion.

In another aspect of the above embodiment, the lint-removing brush further comprises an indicator attached to the lint-removing portion, where a portion of the lint-removing material is orientated in a direction, and where the indicator points in the direction. In another preferred embodiment of the above lint-removing brush, the lint-removing brush further comprises a foam pad between the lint-removing portion and the lint-removing material. In one aspect of the above embodiment, the lint-removing brush comprises a pad support between the lint-removing portion and the foam pad. In another aspect of the above embodiment, the pad support includes a first pad support portion, a second pad support portion, and a rounded surface connecting the first pad support portion and the second pad support portion, where the first and second pad support portion each includes an alignment rail and a locating slot. In another aspect of the above embodiment, the first side of the lint-removing portion includes a latch for engaging with the locating slot of the first pad support portion and includes a guide for engaging with the alignment rail of the first pad support portion and where the second side of the lint-removing portion includes a latch for engaging with the locating slot of the second pad support portion and includes a guide for engaging with the alignment rail of the second pad support portion.

The present invention provides yet another alternative lint-removing brush. In one preferred embodiment of this lint-removing brush, the lint-removing brush comprises: a brush axis; a handle portion including a free end and a connecting end opposite the free end; a lint-removing portion including a free end, a connecting end opposite the free end, and a generally parallel first side surface at a non-parallel angle relative to the brush axis, where the connecting end of the handle portion is connected to the connecting end of the lint-removing portion; and lint-removing material attached to the generally parallel first side surface of the lint-removing portion, where when the lint-removing material contacts a surface to be cleaned, the handle portion is non-parallel to the surface.

In another preferred embodiment of the above lint-removing brush, the lint-removing portion includes a first side and a second side opposite the first side, where the distance between the first side and the second side near the free end is less than the distance between the first side and the second side near the connecting end. In another preferred embodiment of the above lint-removing brush, the lint-removing material extends from the first side to the second side around the free end of the lint-removing portion. In another preferred embodiment of the above lint-removing brush, the lint-removing brush further comprises an indicator attached to the lint-removing portion, where a portion of the lint-removing material is orientated in a direction, and where the indicator points in the direction.

In another aspect of the above embodiment, the lint-removing brush further comprises a foam pad between the lint-removing portion and the lint-removing material. In one aspect of this embodiment, the lint-removing brush further comprises a pad support between the lint-removing portion and the foam pad. In another aspect of this embodiment, the pad support includes a first pad support portion, a second pad support portion, and a rounded surface connecting the first pad support portion and the second pad support portion, where the first and second pad support portion each includes an alignment rail and a locating slot. In yet another aspect of this embodiment, the first side of the lint-removing portion includes a latch for engaging with the locating slot of the first pad support portion and includes a guide for engaging with the alignment rail of the first pad support portion and where the second side of the lint-removing portion includes a latch for engaging with the locating slot of the second pad support portion and includes a guide for engaging with the alignment rail of the second pad support portion.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides a lint-removing brush. The lint-removing brush of the present invention is designed to pick up or clean particles or contaminants, such as lint, hair, threads, dirt, dust, or any other matter from a surface, such as floors, ceilings, furniture or other items, work surfaces, or clothing, to clean the surface. The term "lint-removing" as used herein, including the claims, is not limited to just removing only lint, but rather is for removing any type of particles or contaminants, such as lint, fuzz, hair, threads, dirt, dust, or any other matter from a surface. The lint brush is useful for cleaning adjoining surface at once, such as corners of walls. The lint brush is also useful for cleaning between different sections of an article, such as the back and seat of couch or chair, or between the sections of a couch.

Figure 1:
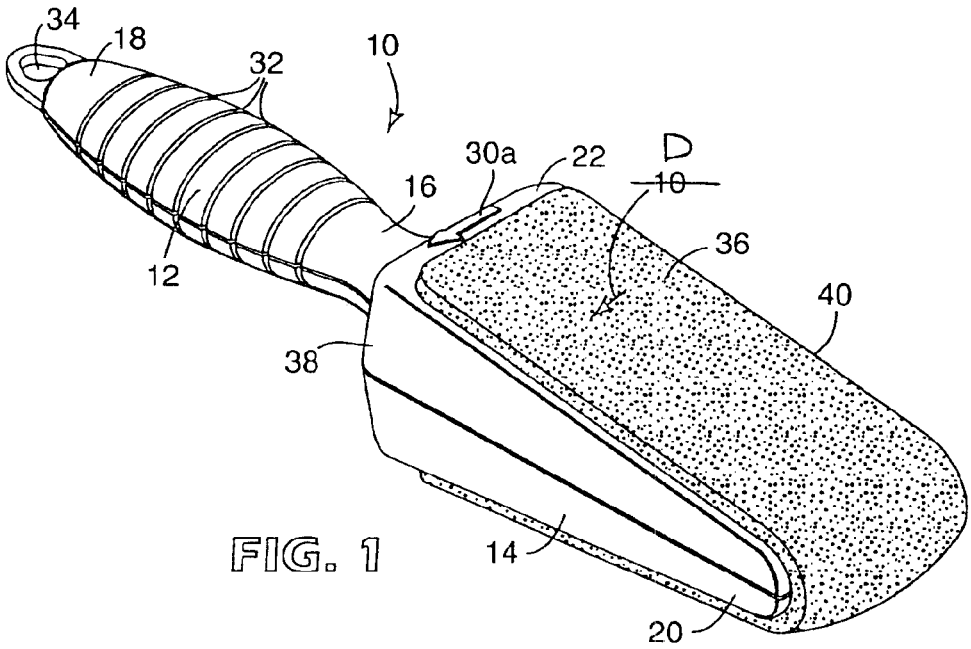
FIG. 1 is a perspective view of the lint-removing brush of the present invention.
Figure 2:
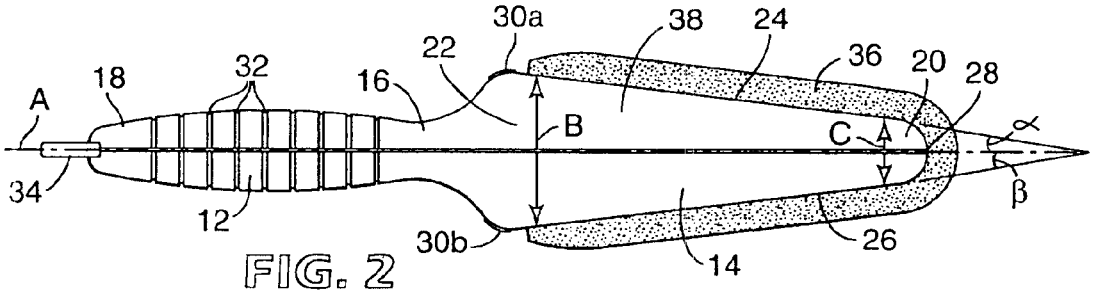
FIG. 2 is a side view of the lint-removing brush of FIG. 1.

FIGS. 1 and 2 illustrate one embodiment of the lint brush 10 of the present invention. Lint brush 10 includes a handle portion 12 and a lint-removing portion 14. The brush 10 includes a brush axis designated by line A in FIG. 2, which is also the same axis for the handle portion 12 and the lint-removing portion 14.

The handle portion 12 can have any shape and can be contoured to ergonomically fit a hand. The handle portion 12 has a free end 18 and a connecting end 16. The free end 18 may have an optional opening 34 to permit hanging the applicator brush 10 on a hook for storage. The handle portion 12 includes optional groves 32.

The lint-removing portion 14 also includes a free end 20 and a connecting end 22. The connecting end 22 of the lint-removing portion 14 is connected to the connecting end 16 of the handle portion 12. The handle portion 12 and the lint-removing portion 14 may be molded as a one-piece construction to be connected to each other. Alternatively, the handle portion 12 and lint-removing portion 14 may be two discrete pieces that are attached together by any means known in the art.

The lint-removing portion 14 includes a first side 24 and a second side 26 opposite the first side 24. Each side includes a surface for receiving the lint-removing material 36. The lint-removing portion also includes a surface 28 connecting the first side 24 and the second side 26. Preferably, the first side 24, the second side 26 and surface 28 are one continuous piece. Preferably, the surface 28 is rounded. However, the surface 28 may also be a very narrow surface where the first side 24 and second side 26 meet at a point or a line. The lint-removing portion 14 also includes a third side 38 and a fourth side 40 opposite the third side 38. The third side is adjacent to and preferably connected to the first side 24 and the second side 26. The fourth side is adjacent to and preferably connected to the first side 24 and the second side 26.

The first side 24 of the lint-removing portion is arranged at an angle $\alpha$ relative to the brush axis A. The second side 26 of the lint-removing portion is arranged at an angle $\beta$ relative to the brush axis. Preferably, angle $\alpha$ and angle $\beta$ are the same angle. Preferably, angle $\alpha$ and angle $\beta$ are in the range of 5° and 12°. More preferably, angle $\alpha$ and angle $\beta$ are in the range of 6° and 8°. Preferably, the third side 38 and fourth side 40 of the lint-removing portion are parallel to one another. Alternatively, the third side 38 and second side 40 of the lint-removing portion may be at non-parallel angles relative to the brush axis A.

Preferably, the lint-removing portion 14 of the brush 10 becomes progressively thicker from the free end 20 to the connecting end 22. In other words, the distance measured between the first side 24 and the second side 26 progressively increases from the free end 20 to the connecting end 22. As an example, the distance between the first side 24 and second side 26 indicated by line C measured near the free end 20 is less than the distance between the first side 24 and second side 26 indicated by line B measured near the connecting end 22. To state it another way, the first side surface 24 and second side surface 26 are at non-parallel angles relative to the brush axis A to form a wedge-shaped lint-removing portion 14.

The brush 10 includes lint-removing material 36 attached to the lint-removing portion. This lint-removing material 36 includes cut or uncut loops of fibers, such as natural fibers, synthetic fibers, glass fibers, thread or wool. Preferably, the fibers are nylon fibers. A majority of the fibers are preferably orientated or tilted in one direction, as indicate by arrow D.

Examples of lint-removing material 36 are well known in the art, such as pile material, or as the brush material disclosed in U.S. Pat. No. 4,642,835 (Schmitz) "Two-Sided Brush and Container," or as brush material disclosed in U.S. Pat. No. 3,765,046 (Tsuruzawa) "Cleaning Brush." One suitable example of the lint-removing material 36 is commercially available as "De-lint fabric material" from Dalian Corporation based in Dalian, China.

Preferably, one length of the lint-removing material 36 continuously extends around the free end 20 of the lint-removing portion 14, intersecting the brush axis A. More preferably, the length of lint-removing material 36 is continuous and is attached to the first side 24, the rounded surface 28, and the second side 26 of the lint-removing portion 14. However, the lint-removing material 36 may be several discrete pieces attached to the sides 24, 26 and surface 28 of the lint-removing portion 14. For example, the brush 10 could include one discrete piece of lint-removing material 36 attached to the first side 24 and another discrete piece of lint-removing material 36 is attached to the second side 26, leaving the entire free end or a portion of the free end 20 of the lint-removing portion 14 exposed between the two discrete pieces of lint-removing material. As another example, the brush 10 could include one continuous piece of lint-removing material attached to the lint-removing portion, where the piece could have sections removed to reveal portions of the lint-removing portion 14 underneath, such as portions of the free end 20 or portions of the first or second sides 24, 26. The brush 10 includes indicators 30 for pointing in the direction that the brush 10 is to be is pressed or pulled or rubbed or slid against a surface to be cleaned. The brush 10 includes a first indicator 30*a* on the first side 24 and a second indicator 30*b* on the second side opposite the first indicator 30*a*. The first indicator 30*a* and second indicator 30*b* are in the shape of arrows. The arrows indicate the direction in which the fibers in the lint-removing material are tilted or orientated. For example, the first indicator 30*a* points in the same direction as the fibers in the lint-removing material 36 attached to the first side 24 of the lint-removing portion 14 are tilted or orientated. The second indicator 30*b* points in the same direction as the fibers in the lint-removing material 36 attached to the second side 26 of the lint-removing portion 14 are tilted or orientated. This arrangement of the indicators 30*a*, 30*b* help a user orientate which way to slide the brush 10 against a surface to be cleaned. As an example, a user sees the arrow 30*a* and knows to brush the lint-removing material 36 on the second side 26 against a surface to be cleaned in the direction of the arrow 30*a*.

When it is desired to remove the lint or other particles and contaminants from the lint-removing material of the brush to clean the brush, the brush 10 may be pressed against a cloth or other piece of material having a relatively rough surface or by a user's hand in the opposite direction as the arrow indicator. By moving the brush in the opposite direction as the arrow indicates, the lint or other particles and contaminants may be easily removed from the fibers.

Figure 3:
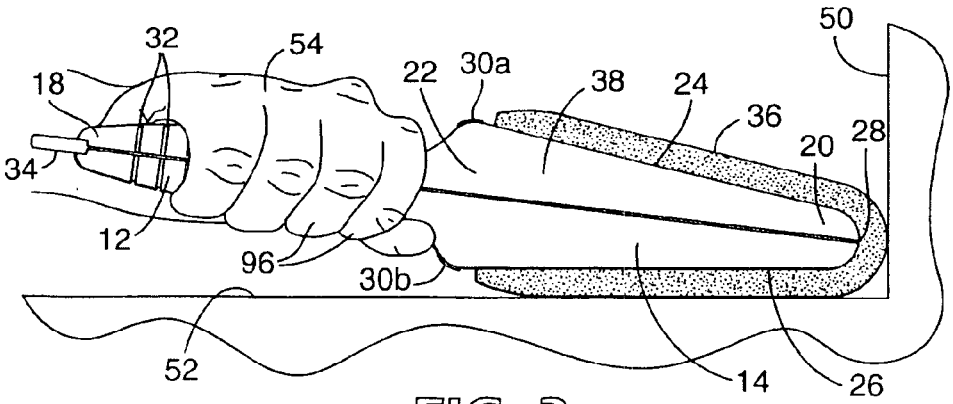
FIG. 3 is a side view of the lint-removing brush of FIG. 2 in use.

FIG. 3 illustrates the lint brush 10 in use, cleaning surfaces 50 and 52. When the handle portion of the brush is grasped by a user's hand 54, the lint-removing portion is pressed against or pulled against or rubbed against a surface 52 to be cleaned and slid in the direction indicated by the arrow as seen by the user, which is the indicator 30*a* in this figure. Alternatively, the user may flip the brush 10 over and rub the other side of the brush 10 against the surface 52. When the second side of the lint-removing portion 14 is laid flat against a surface 52 to be cleaned, the user's hand and particularly the user's fingers that are grasping the handle portion 12 do not contact or brush against the surface 52 because the second side 26 is at an angle relative to the brush axis or handle axis. The portion of the lint-removing material 36 on the free end 20 of the lint-removing portion 14 of the brush 10 may clean the surface 52 or be used to clean a narrow area or corner. As illustrated, the brush may simultaneously clean two opposing surfaces 50, 52 or be used to clean a corner between two opposing surfaces 50, 52.

Figure 4:
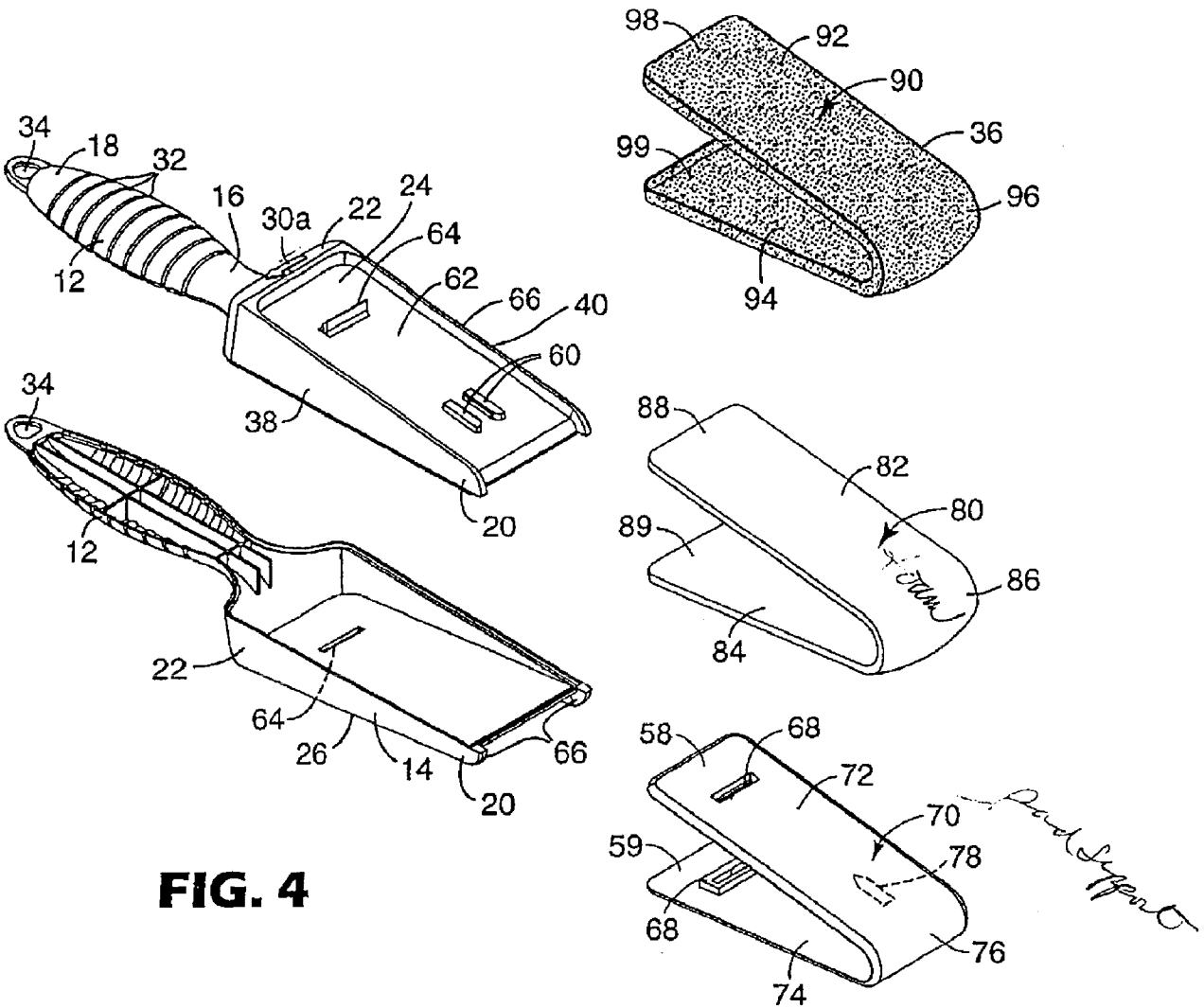
FIG. 4 is an exploded view of the lint-removing brush of FIG. 1.

FIG. 4 is an exploded view of one embodiment of the lint-removing brush 10. The lint-removing portion 14 and handle portion 12 are hollow and in two separate pieces, which may be sonically welded together to form one unitary brush. The first side 24 and second side 26 of the lint-removing portion 14 both include a raised edge 66 along the outside of the sides 24, 26 defining an insert area 62. The first side 24 and second side 26 both include a latch 64 and two guides 60 attached to the insert area 62. Preferably, the latch 64 and guides 60 are perpendicular relative to each other on the insert area 62.

The lint brush 10 includes a lint-removing material portion 90 made of the lint-removing material 36. The lint-removing portion 90 includes a first portion 98, a second portion 99, and a middle portion 96 connecting the first portion 98 and the second portion 99. Preferably, the first portion 98, second portion 99, and middle portion 96 are one continuous piece. However, the portions 98, 99, 96 may be individual discrete portions. The lint-removing material portion 90 includes a first or exterior surface 92 and a second or interior surface 94 opposite the first surface 92.

The lint brush 10 includes a foam pad 80. The foam pad 80 includes a first portion 88, a second portion 89, and a middle portion 86 connecting the first portion 88 and the second portion 89. Preferably, the first portion 88, second portion 89, and middle portion 98 are one continuous piece. However, the portions 88, 89, 86 may be individual discrete portions. The foam pad 80 includes a first or exterior surface 82 and a second or interior surface 84 opposite the first surface 82. Preferably, the foam pad 80 is made of a resilient support material or foam or other spongy material, such as foamed polyurethane.

The lint brush 10 includes a pad support 70. The pad support 70 includes a first portion 58, a second portion 59, and a middle portion 76 connecting the first portion 58 and the second portion 59. Preferably, the first portion 58, second portion 59, and middle portion 76 are one continuous piece. However, the portions 58, 59, 76 may be individual discrete portions. The pad support 70 includes a first surface 72 and a second surface 74. The first portion 58 and second portion 59 of the pad support 70 both include a locating slot 68 and an alignment rail 78. Preferably, the locating slot 68 and alignment rail 78 are perpendicular relative to each other on the second or interior surface 74.

To assemble the parts of the lint-removing brush 10 illustrated in FIG. 4, the lint-removing portion 14 and handle portion 12 may be sonically welded together to form one unitary brush. Next, the lint-removing material portion 90, foam pad 80, and pad support 70 are assembled to contact the first or exterior surface 82 of the foam pad 80 with the second or interior surface 94 of the lint-removing material portion 90 and to contact the second or interior surface 84 with the first or exterior surface 72 of the pad support 70. Glue is then applied along the interior surface 74 of the pad support 70 and the lint-removing material portion 90 is wrapped around the foam pad 80 to bond with the glue on the pad support. Lastly, the sub-assembly of the lint-removing material portion 90, foam pad 80, and pad support 70 are attached to the lint-removing portion 14 of the brush 10 by sliding the alignment rails 78 on interior surface 74 of the pad support 70 to engage with the guides 60 on the lint-removing portion 14 and by engaging the locating slots 68 on the pad support 70 with the latch 64 on the lint-removing portion 14.

Although, the lint-removing material 36 is illustrated as permanently attached to the lint-removing portion 14 of the brush 10, the lint-removing material 36 may be releasably attached to the lint-removing portion 14 to make it replaceable. Alternatively, the sub-assembly of the lint-removing material portion 90, foam pad 80 and pad support 70 could be releasably attached from the lint-removing portion 14, to replace it with a new lint-removing portion 90, foam pad 80, and pad support 70 to allow a user to remove a used lint-removing material portion 90, foam pad 80 and pad support 70 to replace it with a new sub-assembly.

The lint-removing portion 14, handle portion 12 and pad support 70 are preferably made of a plastic material. Blow molding, injection molding, and other manufacturing methods may be used for a making the lint-removing portion 14, handle portion 12, and pad support 70. The lint-removing portion 14, handle portion 12 may be made into a one-piece construction for the brush 10. Alternatively, the lint-removing portion 14 and handle portion 12 may comprise two separate pieces, as illustrated in FIG. 4, with one piece being the top section and other piece being the bottom section of the brush 10, where both the top and bottom sections each contain a portion of the lint-removing portion 14 and handle portion 12.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A lint-removing brush, comprising a lint removing material:

a handle portion including a free end and a connecting end opposite the free end;

a lint-removing portion including a free end and a connecting end opposite the free end and including a first side and a second side opposite the first side, wherein the distance between the first side and the second side near the free end is less than the distance between the first side and the second side near the connecting end, and wherein the connecting end of the handle portion is connected to the connecting end of the lint-removing portion;

a pad support including a rounded surface connecting a first pad support portion and a second pad support portion, the first and second pad support portions each including an alignment rail and a locating slot connecting the pad support to the lint-removing portion; and a foam pad disposed over the pad support extending from the first pad support portion to the second pad support portion around the rounded surface wherein the lint removing material is attached to the foam pad.

2. The lint-removing brush of claim 1, wherein the lint-removing material extends from the first side to the second side around the foam pad.

3. The lint-removing brush of claim 1, further comprising an indicator attached to the lint-removing portion, wherein a portion of the lint-removing material is orientated in a direction, and wherein the indicator points in the direction.

4. The lint-removing brush of claim 1, wherein the first side of the lint-removing portion includes a latch for engaging with the locating slot of the first pad support portion and includes a guide for engaging with the alignment rail of the first pad support portion and wherein the second side of the lint-removing portion includes a latch for engaging with the locating slot of the second pad support portion and includes a guide for engaging with the alignment rail of the second pad support portion.

5. A lint-removing brush, comprising:

a handle portion and a lint-removing portion connected to the handle portion, wherein the brush includes a brush axis;

a pad support including a rounded surface connecting a first pad support portion and a second pad support portion, the first and second pad support portions each including an alignment rail and a locating slot connecting the pad support to the lint-removing portion;

a foam pad disposed over the pad support; and lint-removing material attached to the foam pad, wherein each of the pad support the foam pad and the lint-removing material intersects with the brush axis.

6. The lint-removing brush of claim 5, wherein the lint-removing portion includes a free end and a connecting end opposite the free end, a first side and a second side opposite the first side, wherein the distance between the first side and the second side near the free end is less than the distance between the first side and the second side near the connecting end.

7. The lint-removing brush of claim 6, wherein the lint-removing material extends from the first side to the second side around the free end of the lint-removing portion.

8. The lint-removing brush of claim 5, further comprising an indicator attached to the lint-removing portion, wherein a portion of the lint-removing material is orientated in a direction, and wherein the indicator points in the direction.

9. The lint-removing brush of claim 5, wherein the first side of the lint-removing portion includes a latch for engaging with the locating slot of the first pad support portion and includes a guide for engaging with the alignment rail of the first pad support portion and wherein the second side of the lint-removing portion includes a latch for engaging with the locating slot of the second pad support portion and includes a guide for engaging with the alignment rail of the second pad support portion.

10. A lint-removing brush, comprising:

a brush axis;

a handle portion including a free end and a connecting end opposite the free end;

a lint-removing portion including a free end, a connecting end opposite the free end, and a first side surface formed at an angle relative to the brush axis, wherein the connecting end of the handle portion is connected to the connecting end of the lint-removing portion;

a pad support including a rounded surface connecting a first pad support portion and a second pad support portion, the first and second pad support portions each including an alignment rail and a locating slot connecting to pad support over the free end of the lint-removing portion;

a foam pad extending around the rounded surface of the pad support; and lint-removing material attached to the foam pad;

wherein when the lint-removing material contacts a surface to be cleaned the handle portion is non-parallel to the surface.

11. The lint-removing brush of claim 10, wherein the lint-removing portion includes a first side and a second side opposite the first side, wherein the distance between the first side and the second side near the free end is less than the distance between the first side and the second side near the connecting end.

12. The lint-removing brush of claim 11, wherein the lint-removing material extends around the rounded surface formed by the foam pad extending around the rounded surface of the pad support.

13. The lint-removing brush of claim 10, further comprising an indicator attached to the lint-removing portion, wherein a portion of the lint-removing material is orientated in a direction, and wherein the indicator points in the direction.

14. The lint-removing brush of claim 10, wherein the first side of the lint-removing portion includes a latch for engaging with the locating slot of the first pad support portion and includes a guide for engaging with the alignment rail of the first pad support portion and wherein the second side of the lint-removing portion includes a latch for engaging with the locating slot of the second pad support portion and includes a guide for engaging with the alignment rail of the second pad support portion.

15. The lint-removing brush of claim 1, wherein the handle portion and the lint-removing portion are defined by an integrally formed top section and an integrally formed bottom section, each of the top and bottom sections including a portion of the handle portion and the lint-removing portion.

16. The lint-removing brush of claim 1, wherein the lint-removing material is configured to be releasably attached to the foam pad.

17. The lint-removing brush of claim 1, wherein the lint-removing material is selected from the group consisting of natural fiber, synthetic fiber, uncut loops of fiber, and cut loops of fibber.

* * * * *

UNITED STATES PATENT AND TRADEMARK OFFICE

CERTIFICATE OF CORRECTION

PATENT NO. : 6,901,622 B2
DATED : June 7, 2005
INVENTOR(S) : Thompson et al.

It is certified that error appears in the above-identified patent and that said Letters Patent is hereby corrected as shown below:

Column 7,
Line 46, after "comprising" insert -- : --.
Line 47, after "material" delete ":" and insert -- ; --, therefor.

Column 8,
Lines 43 and 47, after "wherein" delete "the" and insert -- a --, therefor.
Line 66, delete "to" and insert -- the --, therefor.

Column 9,
Line 6, after "is" insert -- configured to be --.
Line 23, after "wherein" delete "the" and insert -- a --, therefor.

Column 10,
Line 3, after "wherein" delete "the" and insert -- a --, therefor.
Line 21, delete "fibber" and insert -- fiber --, therefor.

Signed and Sealed this

Fifteenth Day of November, 2005

JON W. DUDAS
*Director of the United States Patent and Trademark Office*